US011879698B2

(12) United States Patent
Fehrenbach

(10) Patent No.: US 11,879,698 B2
(45) Date of Patent: Jan. 23, 2024

(54) NON-METALLIC FIREARM BOLT AND METHOD OF MANUFACTURING THEREOF

(71) Applicant: Tad Fehrenbach, Auburndale, WI (US)

(72) Inventor: Tad Fehrenbach, Auburndale, WI (US)

( * ) Notice: Subject to any disclaimer, the term of this patent is extended or adjusted under 35 U.S.C. 154(b) by 144 days.

(21) Appl. No.: 17/691,458

(22) Filed: Mar. 29, 2022

(65) Prior Publication Data

US 2022/0341685 A1 Oct. 27, 2022

Related U.S. Application Data

(63) Continuation of application No. 63/159,742, filed on Mar. 11, 2021.

(51) Int. Cl.
*F41A 3/26* (2006.01)

(52) U.S. Cl.
CPC ..... *F41A 3/26* (2013.01)

(58) Field of Classification Search
CPC ..... F41A 3/12; F41A 3/14; F41A 3/16; F41A 3/18; F41A 3/20; F41A 3/22; F41A 3/24; F41A 3/26; F41A 3/28; F41A 3/30
See application file for complete search history.

(56) References Cited

U.S. PATENT DOCUMENTS 5,755,056 A * 5/1998 Danner ..... F41A 3/22 42/84
5,987,798 A * 11/1999 Ronkainen ..... F41A 19/70 42/16
7,735,410 B2 6/2010 Clark
8,561,337 B2 10/2013 Lewis

FOREIGN PATENT DOCUMENTS

WO WO-9937967 A1 * 7/1999 ..... F41A 19/70

* cited by examiner

*Primary Examiner* — Jonathan C Weber
(74) *Attorney, Agent, or Firm* — Carlin Law LLC

(57) ABSTRACT

A non-metallic sleeve device adapted for use with a firearm bolt. The non-metallic sleeve is generally durable, heat resistant, and generally nonmalleable. The bolt may be used on a bolt action, semiautomatic, or automatic firearm. There are two steel ends of the bolt each with an inner portion and an outer portion, said inner portion having a reduced diameter and screw threading thereon. A non-metallic tube, comprising a material such as carbon fiber, may be epoxied in position onto the screw threading. The result is reduced weight of the firearm bolt.

9 Claims, 11 Drawing Sheets

NON-METALLIC FIREARM BOLT AND METHOD OF MANUFACTURING THEREOF

CROSS REFERENCE TO RELATED APPLICATION

This application claims the benefit of U.S. Provisional Application 63/159,742, filed Mar. 11, 2021.

FIELD

The present invention relates to the field of firearms and, more particularly, is directed to the field of firearm bolts made partially with a non-metallic material as well as the method of manufacturing said non-metallic firearm bolts.

INTRODUCTION

A wide array of firearms have been in use for hundreds of years. In the late $19^{th}$ century, bolt action firearms were created, which shifted the standard most common firearm from a muzzle loader to a breechloading firearm. The breechloading firearm is where the ammunition round is loading towards the rear of the barrel, nearest the trigger. The bolt is generally located between the rearward end of the barrel and the ammunition itself. Generally, the bolt will be contained within a bolt carrier, which also employs a firing pin.

Typically, bolt-action firearms require a firearm user to cycle the bolt, extract a round, and then load new rounds before manually re-engaging the bolt in place. However, semi-automatic and automatic firearms have also been developed, wherein the bolt is pushed rearward after a round is fired by the emission of gas from the activation of the round. These types of firearms will extract the spent ammunition round and load an additional round before re-engaging the bolt in place. Firearms employing a bolt, including the above-mentioned direct gas operated versions, have been in use by the civilian population and military personnel for many years, and many variations have been developed and employed.

The civilian population currently uses bolt-action firearms for a variety of purposes, such as general target shooting, home defense, and hunting, to name a few. When out hunting, a hunter may dress up in multiple layers of cold weather gear while walking a great distance with their rifle, and a bag of equipment, to include extra ammunition, binoculars, cold weather gear, and a lunch. The hunter will thus be carrying much more weight than they typically do and are quite encumbered at times. Any method in order to reduce this weight is usually employed, to include multiple trips to and from a hunting location.

Further, when a target is in sight, if a hunter raises their firearm up to shoulder-height in order to view said target through a scope or an optic, the weight of the firearm becomes an exponentially increasing factor as, after some time, many users cannot maintain a steady position for an extended period of time. This causes the firearm to slightly bounce due to the shaking of the user's muscles, and results in poor accuracy, and can also become a safety hazard.

What is needed, therefore, is a device which can reduce the weight of a rifle, while also properly and safely being employed therein.

BRIEF SUMMARY OF THE INVENTION

The present invention is directed to a firearm bolt of which is partially non-metallic, and to the method of manufacturing said partially non-metallic firearm bolts. The same may also be used for manufacturing of firearm bolt carriers. Almost all bolts for firearms today are entirely metallic. Metallic components provide general durability and resistance to heat, of which both characteristics are essential in firearm components. Further, metallic components are not easily malleable, so wear-and-tear has a lessened effect as to some other materials. However, other non-metallic materials are also generally durable, resistant to heat, and non-malleable as well. Some examples of these types of materials are carbon fiber, synthetic fiber such as Kevlar, Nomex, composites such as reinforced plastics or polymers, ceramics, fiberglass, or the like. It is specifically contemplated that other materials with similar characteristics which are non-metallic may be employed within the spirit of this disclosure.

As previously mentioned, a bolt is generally a moving component which blocks the entrance as to the rearward opening of the firearm barrel from the firing location when the bolt is in a cocked, or ready-to-fire position. Moving the bolt rearward away from the barrel to an open, or un-cocked, position allows access to the breech so as to load another ammunition cartridge. The bolt typically additionally has the firing pin located therein, to activate the primer of an ammunition cartridge.

A bolt carrier group may be employed depending on the type of firearm; typically, a bolt carrier group is used with semi-automatic and automatic firearms. The bolt carrier group is a general name for part of the control which fires the ammunition, extract the spent cartridge, reprime the firearm and load a new cartridge of ammunition therein. The bolt carrier group has multiple parts thereto, such as the bolt itself, an ejector, an extractor, a bolt cam pin, and the firing pin, to name a few. The use of a bolt carrier group in lieu of just a bolt is dependent upon the firearm and the type of firearm employed. As used herein, the term bolt is synonymous with bolt carrier group.

A first preferred embodiment of the present disclosure utilizes a bolt with a non-metallic outer sleeve located at a position between two metallic ends. In such a fashion the bolt, typically generally cylindrical in nature, contains a first end and a second end, wherein said first end additionally comprises lugs for mating or sealing with the firearm throat, otherwise known as the chamber throat. The portion of material between the first end and the second end of the firearm bolt will be a non-metallic outer sleeve, wherein said outer sleeve is constructed of a generally durable, heat resistant material such as carbon fiber or one of the above-mentioned materials. The outer sleeve may be molded or epoxied into position. It may also be mechanically affixed into position. Further, it may utilize frictional, tension, or applied force to maintain its position thereon.

A first bolt piece is provided having an inner end and an outer end. A second bolt piece is also provided having an inner end and an outer end. The two bolt pieces are positioned apart from each other wherein the inner end of the first bolt piece and the inner end of the second bolt piece are positioned linearly with one another. Depending on the type of firearm, the first bolt piece may additionally comprise a bolt lug, or multiple bolt lugs. These bolt lugs contact with the inner mouth of the receiver, to ensure a tight fit and compression chamber for the firing of the ammunition.

The inner end of the first bolt piece is a reduced and therefore smaller diameter than the outer end of the first bolt piece diameter. In a similar fashion, the inner end of the second bolt piece is a reduced diameter and thus is a smaller diameter than the outer end of the second bolt piece diameter. The portion where the reduced diameter of the inner end meets with the greater diameter of the outer end is known as the bolt piece lip.

The inner end of the first bolt piece and the inner end of the second bolt piece additionally each have sleeve threading. The sleeve threading, which may be known alternatively as screw threading, may be a variety of different types such as unified, metric, square, ACME, buttress, or it may be cross-hatched. As used herein, cross-hatched may also be used for a generally criss-crossed pattern, or numerous parallel threads intersecting other numerous parallel threads. It is known that cross-hatched threads may provide for more torque resistance, so as to secure the fit thereon of affixed components such as a non-metallic tube or sleeve or layer. For example, the cross-hatch threading allows for increased torque resistance, while also allowing for consistent application of a greater amount of epoxy.

A non-metallic tube or sleeve is thought of as a generally cylindrical component that is tubular, and therefore hollow. The non-metallic tube has a first open end and a second open end. The first open end is sized such that it receives the entirety of the reduced diameter inner end of the first bolt piece. The non-metallic tube first open end contacts with the first bolt piece lip, such that the exterior diameter of the non-metallic tube is linearly consistent with the exterior diameter of the first bolt piece outer end diameter.

The non-metallic tube second open end is sized such that it receives the entirety of the reduced diameter inner end of the second bolt piece. The non-metallic tube second open end contacts with the second bolt piece lip, such that the exterior diameter of the non-metallic tube is linearly consistent with the exterior diameter of the second bolt piece outer end diameter. Thus, the outer diameter of the first bolt piece outer end, the exterior diameter of the non-metallic tube, and the outer diameter of the second bolt piece outer end are approximately equal.

Alternatively, the exterior diameter of the non-metallic tube may be less than that of the outer diameters of the first bolt piece outer end and the second bolt piece outer end, respectively. In such a circumstance, multiple layers of carbon fiber may be wrapped around the exterior diameter of the non-metallic tube, such that the tube has numerous layers, until the exterior diameter of the sum of the tube and all the wrapped layers approximately equals that of the outer diameter of the first bolt piece outer end and the outer diameter of the second bolt piece outer end. Similarly, it is a concept of the present disclosure that the first bolt piece and the second bolt piece are one formed piece, with at least one non-metallic layer, otherwise known as a tube or a sleeve, wrapped around the central portion, forming a non-metallic generally cylindrical bolt body. The tube, or multiple layers as the case may be, thus has an outer diameter approximately equal to the outer diameter of the first bolt piece outer end and the second bolt piece outer end.

A second preferred embodiment of the present disclosure is a firearm bolt employing a non-metallic material surrounding a firearm bolt with a narrowed-down metallic center. Further, epoxy on the exterior of the metallic center may be used, or it may be pressed in with a frictional, tension, or applied force. In such a fashion, the firearm bolt has a metal first end and a metal second end with a metallic center, said center surrounded by a non-metallic firearm bolt constructed of generally durable, heat resistant material such as carbon fiber or one of the above-mentioned materials. It is specifically contemplated that other materials with similar characteristics which are non-metallic may be employed within the spirit of this disclosure.

Continuing on, a method for creating the non-metallic firearm bolt is contemplated herein. Utilizing a machine that is capable of cutting metal such as steel, one may cut a first steel component end. This first end has an inner end and an outer end, wherein the inner end may additionally comprise a lesser outer diameter than the outer end outer diameter. At least one bolt lug is formed or affixed to the exterior of the outer end on the first steel component. Sleeve threading is formed by way of machining to the inner end outer diameter of the first steel component. Continuing to use machining, a second steel component is provided having an inner end and an outer end, similar to the first steel component. The second steel component inner end has sleeve threading formed by way of machining to its inner end outer diameter. Epoxy is applied to the exterior of the sleeve threading. A non-metallic tube being generally cylindrical and hollow, or having a hole defined therethrough, and having a first end and a second end, is provided wherein the tube first end encapsulates the inner end of the first steel component. The tube second end then encapsulates the inner end of the second steel component. The epoxy on the sleeve threading is thus pressed into place within the interior of the tube inner diameter and allows for securing the tube in position. As described herein, the non-metallic tube may consist of carbon fiber. Additionally, one or both of the sleeve threading on the inner end of the first steel component and the second steel component may be cross-hatched to allow for greater torque resistance, and more consistent epoxy application therefore.

To advance still the improvements contemplated herein, a non-metallic insert made of carbon fiber or one of the above-mentioned materials is inserted within the bolt carrier in one embodiment of the present disclosure. A bolt will slide within part of the bolt carrier on a firearm, and in this embodiment, the bolt slides upon the non-metallic insert. In such a fashion, the weight of the bolt and the bolt carrier are both reduced by employing the lighter non-metallic material.

Finally, some platforms employ a bolt carrier group, as previously mentioned. The bolt carrier of the bolt carrier group is constructed with a non-metallic outer sleeve in another embodiment of the present disclosure. The central portion of the bolt carrier between the rear, or second, end and the central portion wherein the bolt firing pin and extractor rest employ said non-metallic outer sleeve attached by epoxy, molded thereto, or applied by frictional, tension, or applied force. It may also be mechanically affixed into position.

These and various other features, advantages, modes, and objects of the present invention will be made apparent from the following detailed description and any appended drawings.

DRAWINGS DESCRIPTION

One or more preferred exemplary embodiments of the disclosed invention are illustrated in the accompanying drawings in which like reference numerals represent like parts throughout and in which: It is specifically contemplated that other materials with similar characteristics which are non-metallic may be employed within the spirit of this disclosure.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION OF THE PREFERRED EMBODIMENT

Figure 1:
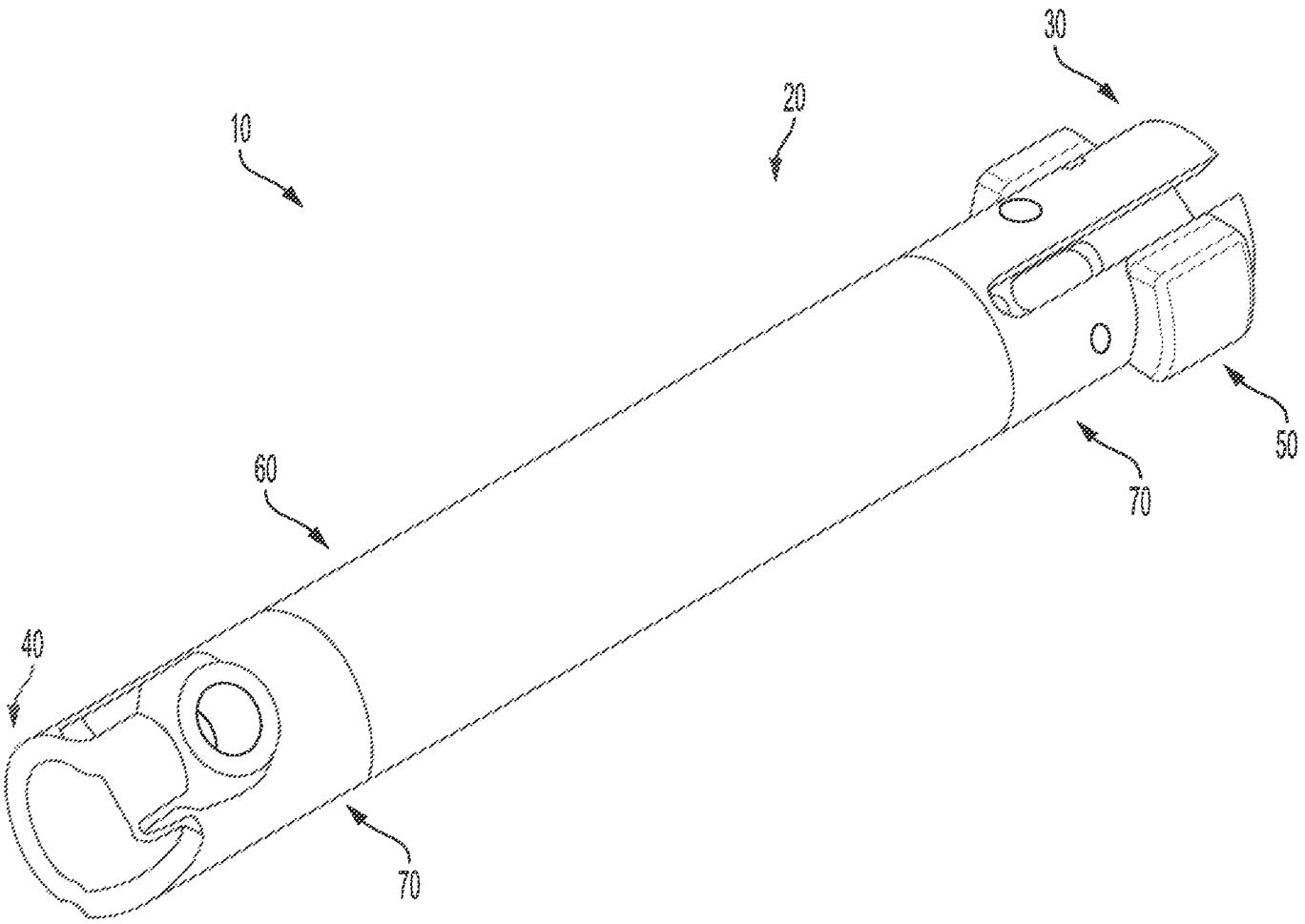
FIG. 1 is a perspective view of a preferred embodiment of the non-metallic firearm bolt.

Referring now to the drawings in detail, FIG. 1 illustrates a preferred embodiment of a non-metallic firearm bolt 10 constructed in accordance with the present invention. This particular embodiment is shown as a generic firearm bolt 20. Said bolt 20 is displayed with a bolt first end 30 and a bolt second end 40. As used and described herein by way of explanation, the first end 30 is the portion of the bolt 20 wherein the lugs 50 are positioned, if applicable.

Figure 10:
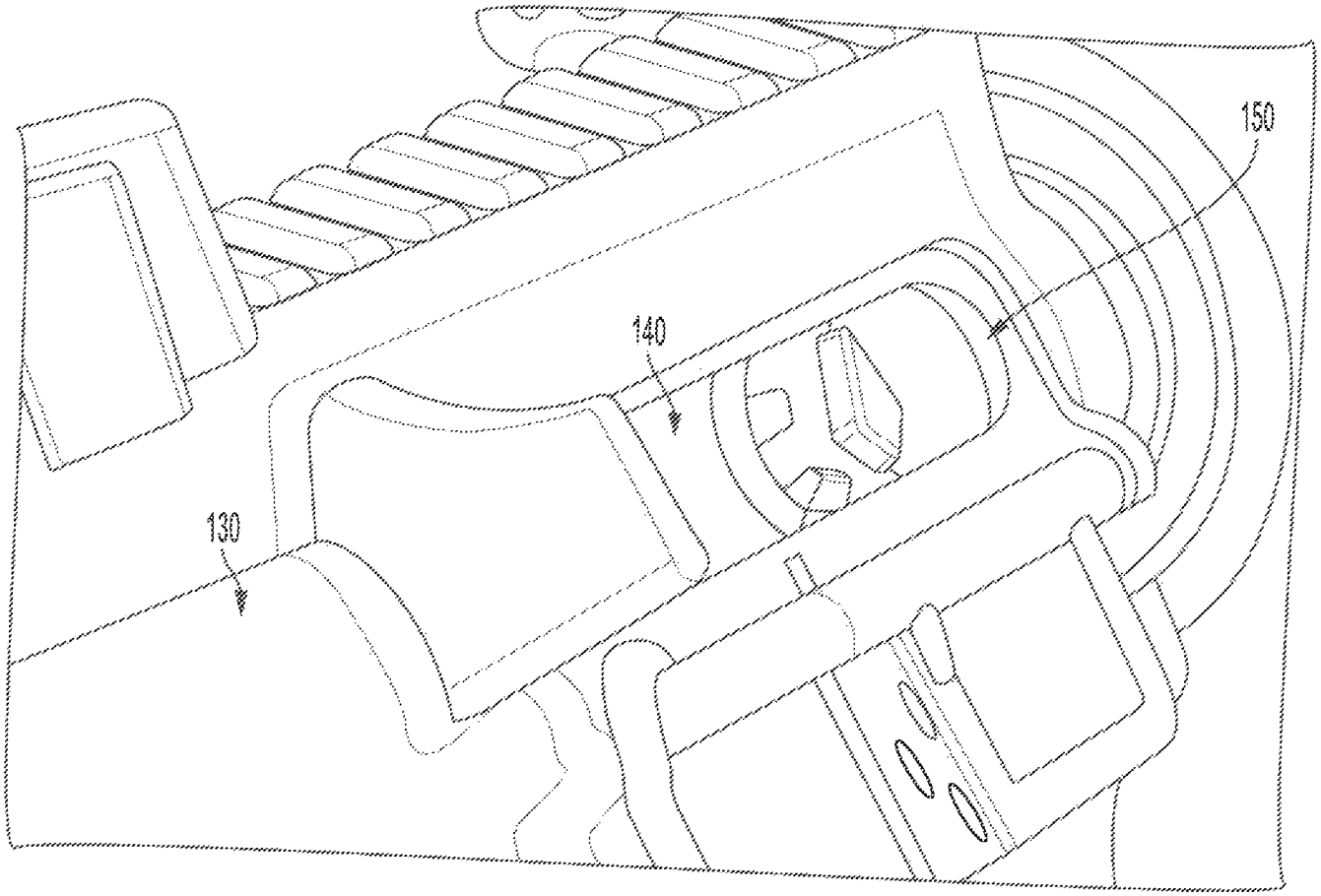
FIG. 10 is a perspective view of a generic firearm and chamber throat thereof.

Said lugs 50 are known as the portion of material which makes contact with the firearm chamber throat 150, as shown in FIG. 10. Going back to FIG. 1, the bolt 20 is shown where the bolt first end 30 and the bolt second end 40 are made of metallic material 70, such as steel. The portion of material disposed therebetween said first end 30 and second end 40 is the non-metallic firearm bolt 10. Said non-metallic firearm bolt 10 is constructed of non-metallic material 60 such as carbon fiber, though it may additionally be comprised as described above, being one of: synthetic fiber such as Kevlar, Nomex, composites such as reinforced plastics or polymers, ceramics, fiberglass, or the like.

Figure 2:
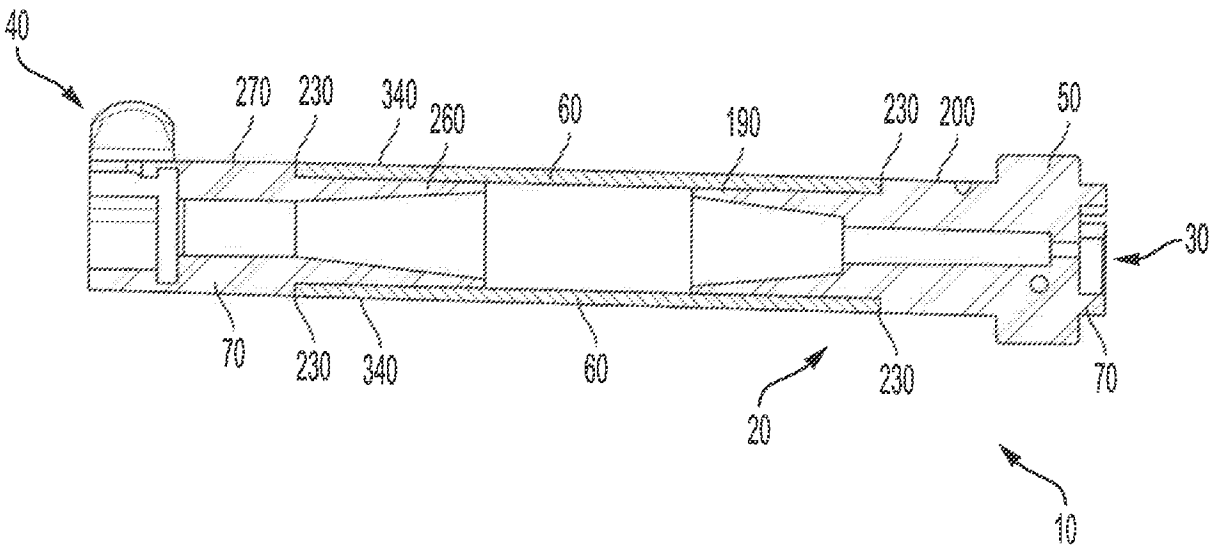
FIG. 2 is a sectional side-view of a preferred embodiment of the non-metallic firearm bolt.

FIG. 2 shows an embodiment of the present disclosure of the non-metallic firearm bolt 10 which is a sectional view thereof. As shown, the non-metallic material 60 surrounds the bolt 20 such that the metallic material 70 of the interior of the bolt 20 itself is generally enclosed by the non-metallic firearm bolt 10. The bolt first end 30 is displayed with the additional material forming a lug 50, as described above. The bolt second end 40 is disposed at the opposing end of the generally cylindrical bolt 20 displayed, wherein the non-metallic firearm bolt 10 is disposed at a position therebetween said two ends of the bolt 20.

Figure 3:
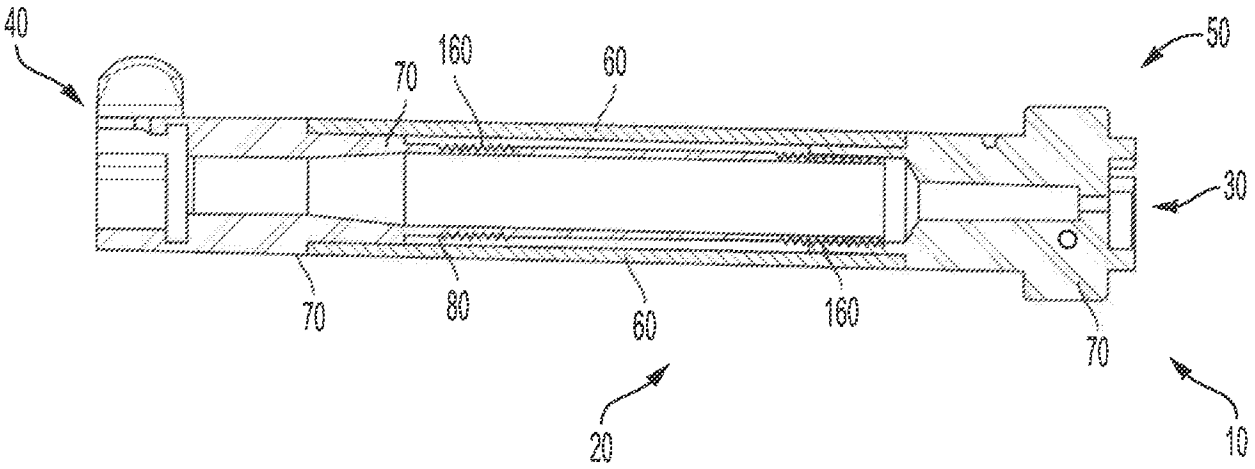
FIG. 3 is a sectional side-view of an embodiment of the non-metallic firearm bolt.

Turning now to FIG. 3, an alternative embodiment of the non-metallic firearm bolt 10 is shown. Similarly to the previously viewed FIG. 2, FIG. 3 is a sectional view of a firearm bolt 20, wherein a non-metallic material 60 enwreathes a generally metallic 70 central portion of the firearm bolt 20, established at a centrally located position as the bolt first end 30 and the bolt second end 40. The non-metallic firearm bolt 10 as shown is affixed such that a pocket 80 is formed between the central metallic 70 portion of the firearm bolt 20 and the non-metallic firearm bolt 10 itself. Additionally, epoxy 160 is utilized here, wherein the non-metallic firearm bolt 10 is epoxied in its position.

Figure 4:
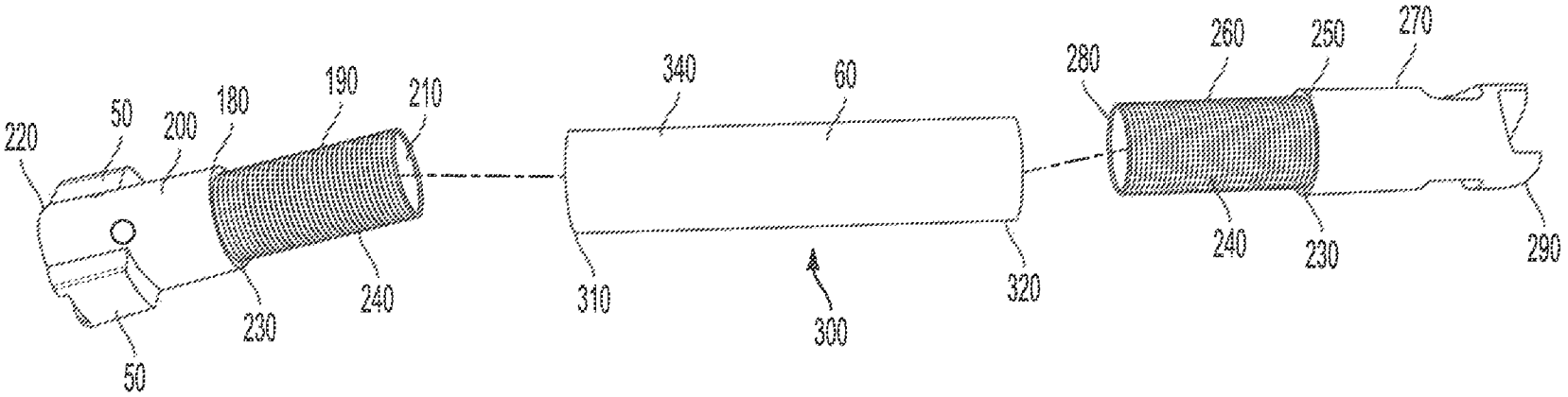
FIG. 4 is an exploded view of an embodiment of the non-metallic firearm bolt.

Looking to FIG. 4, an exploded view of the non-metallic firearm bolt 10 is shown wherein the main components are disengaged from each other, pre-assembly. The non-metallic tube 300 is positioned within the center between the first bolt piece 180 and the second bolt piece 250. The non-metallic tube 300 has a tube first end 310 and a tube second end 320. The tube 300 has an exterior, or outer, diameter 340. The first bolt piece 180 has an inner end 210 being the reduced diameter, or the first bolt piece inner end diameter 190 section. The first bolt piece 180 increases its diameter at the outer end 220, at a portion known as the bolt piece lip 230. The first bolt piece outer end diameter 200 is the greater of the diameters of the first bolt piece 180 itself. On the exterior of this particular bolt 20 are a plurality of bolt lugs 50. Upon the first bolt piece inner end 210 is sleeve threading 240, which as mentioned above may be alternatively referred to as screw threading. The sleeve threading here 240 is cross-hatched, to create greater torque resistance once connected with the non-metallic tube 300. Upon the sleeve threading 240, epoxy 160 is applied, as shown in FIG. 3. Turning back to FIG. 4, the second bolt piece 250 is now addressed. The second bolt piece 250 has an inner end 280 and an outer end 290. The second bolt piece inner end diameter 260 is lesser than that of the second bolt piece outer end diameter 270, as shown. Upon the exterior of the second bolt piece inner end diameter is cross-hatched sleeve threading 240.

Figure 5:
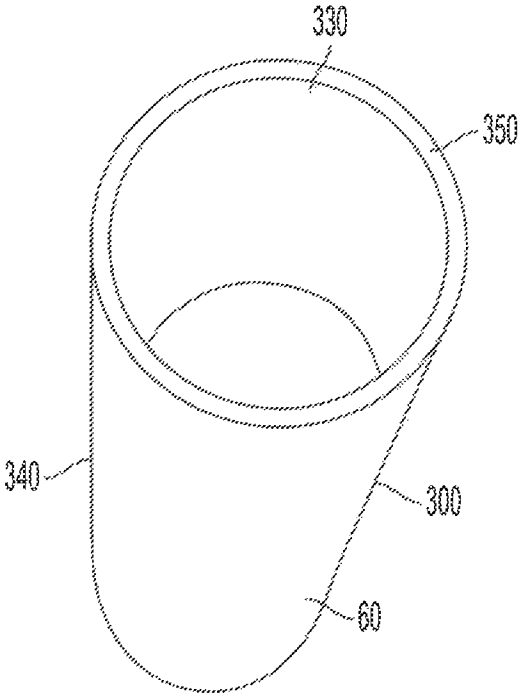
FIG. 5 is a top-down view of a generally cylindrical non-metallic tube, depicting the hollow interior thereof.

A non-metallic tube 300 is shown in FIG. 5 with a top-down view. As shown here, the non-metallic tube 300 is generally cylindrical, and is hollow, or defining a hole therethrough. The non-metallic tube 300 thus has an inner diameter 330, which is sized so as to fit the exterior of the first bolt piece inner end diameter 190, as shown in FIG. 4, as to the tube first end 310, and is sized so as to fit the exterior of the second bolt piece inner end diameter 260 as to the tube second end 320. At the distal end of the tube first end 310 and at the symmetrically distal end of the tube second end 320 is a tube contact lip 350, which is known as the portion of material that makes direct physical contact with the bolt piece lip when the tube 300 receives the first bolt piece 180 and the second bolt piece 250, as shown in FIG. 4.

Figure 6:
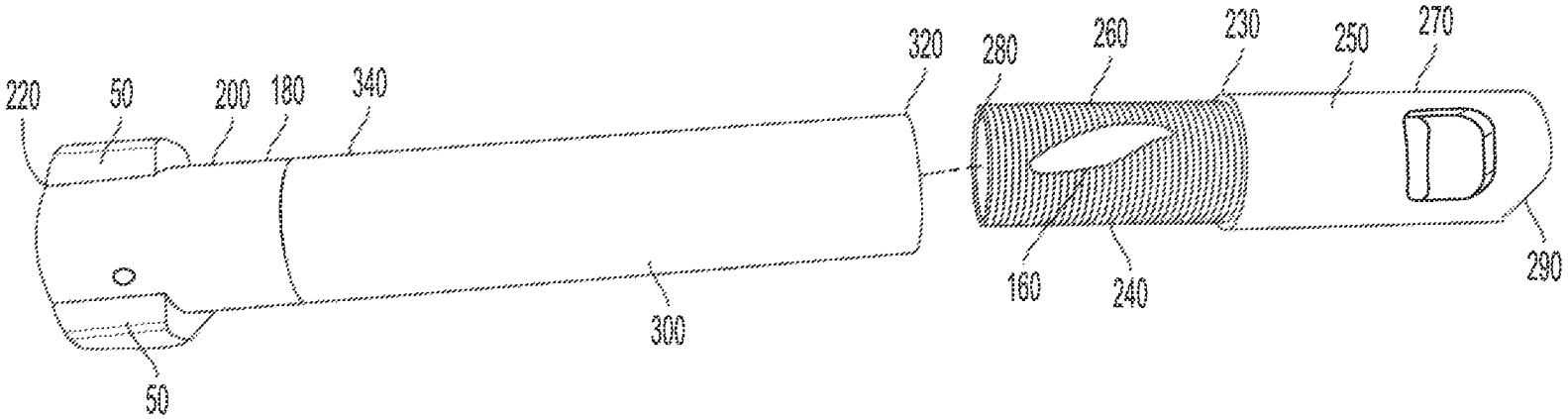
FIG. 6 is an embodiment of the non-metallic firearm bolt, wherein a second bolt piece end is not connected with the non-metallic tube of the firearm bolt.

Turning now to FIG. 6, an embodiment of the present invention is shown wherein the second bolt piece 250 is not connected with the non-metallic tube 300. As is now clear, when the tube 300 encapsulates the first piece inner end diameter 190, the tube contact lip 350 (shown in FIG. 5) makes physical contact with the first bolt piece lip 230 (shown in FIG. 4), such that the tube 300 is affixed in place. The tube outer diameter 340 is thus approximately equal to the first bolt piece outer end diameter 200. The tube second end 320 has an inner diameter 330 sized so as to fit the second bolt piece inner end diameter 260, upon which the tube contact lip 350 will allow the tube 300 to be positioned in place, and wherein epoxy 160 applied to the sleeve threading 240 will secure the tube 300 in position, thus creating a final non-metallic firearm bolt, as shown in FIG. 1.

Figure 7:
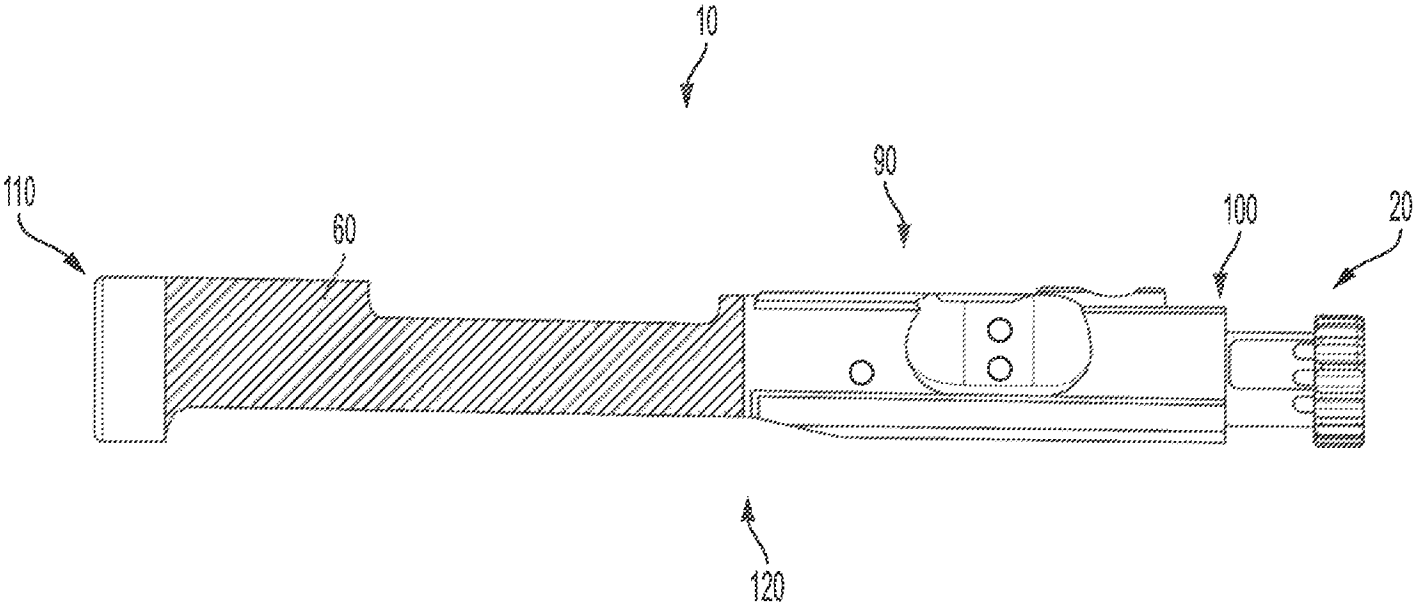
FIG. 7 is a perspective view of a bolt carrier group with non-metallic firearm bolt material upon the bolt carrier of said bolt carrier group.
Figure 8:
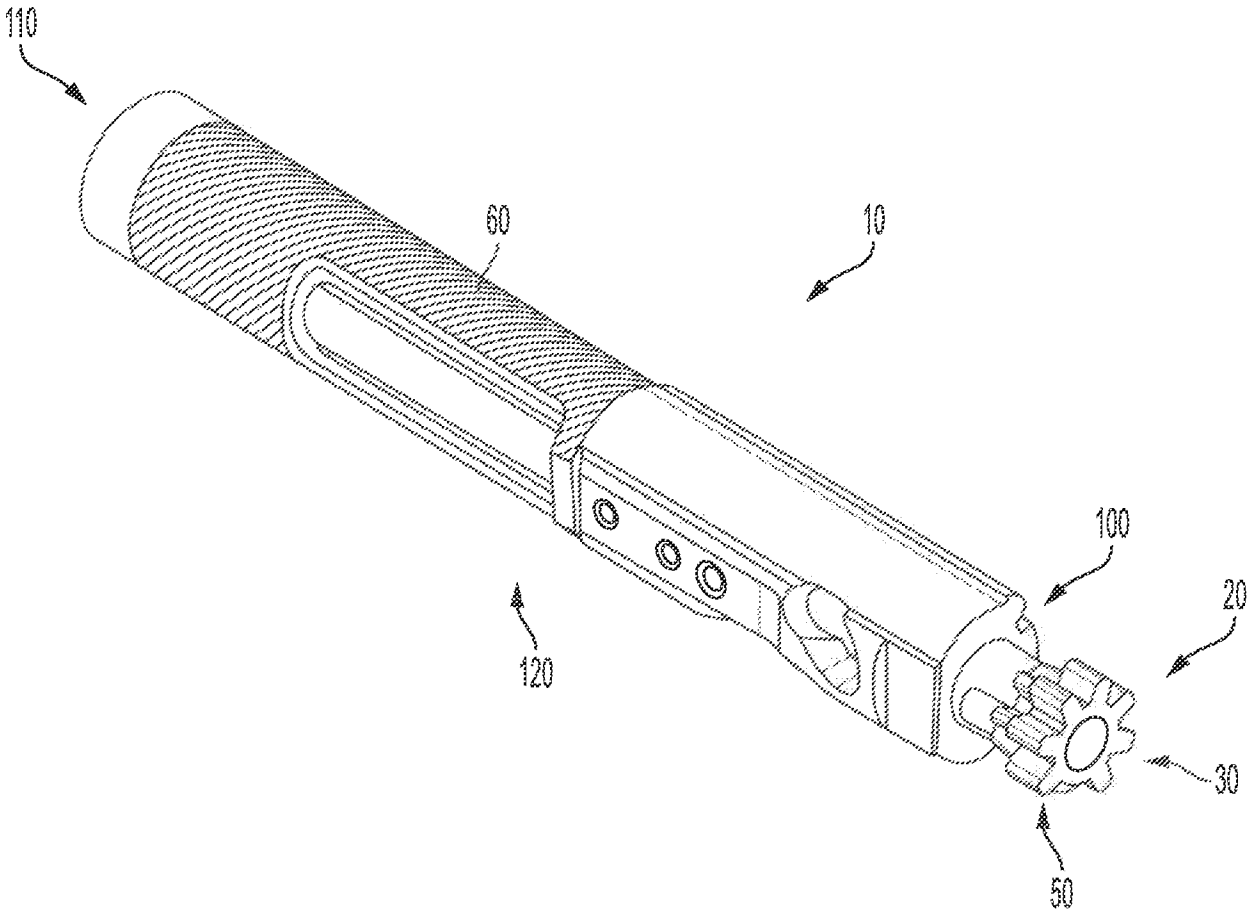
FIG. 8 is an alternative perspective view of a bolt carrier group with non-metallic firearm bolt material upon the bolt carrier of said bolt carrier group.

FIGS. 7-8 highlights a generic firearm bolt carrier group 120. This is known as the combination of a firing pin, an ejector, a bolt carrier and a bolt 20. The bolt carrier group 120 here has a first end 100, which is the portion upon which the bolt 20 extrudes therefrom, and a bolt carrier second end 110 at a distal end therefrom, wherein a non-metallic firearm bolt 10 is positioned therebetween. The non-metallic firearm bolt 10 is made of non-metallic material 60, and is attached by epoxy, molded thereto, or applied by frictional, tension, or applied force. It may also be mechanically affixed into position. The bolt 20 of this bolt carrier group 120 is positioned within a bolt carrier cavity, and slides upon the non-metallic material 60 therein as shown in FIG. 6.

Figure 9:
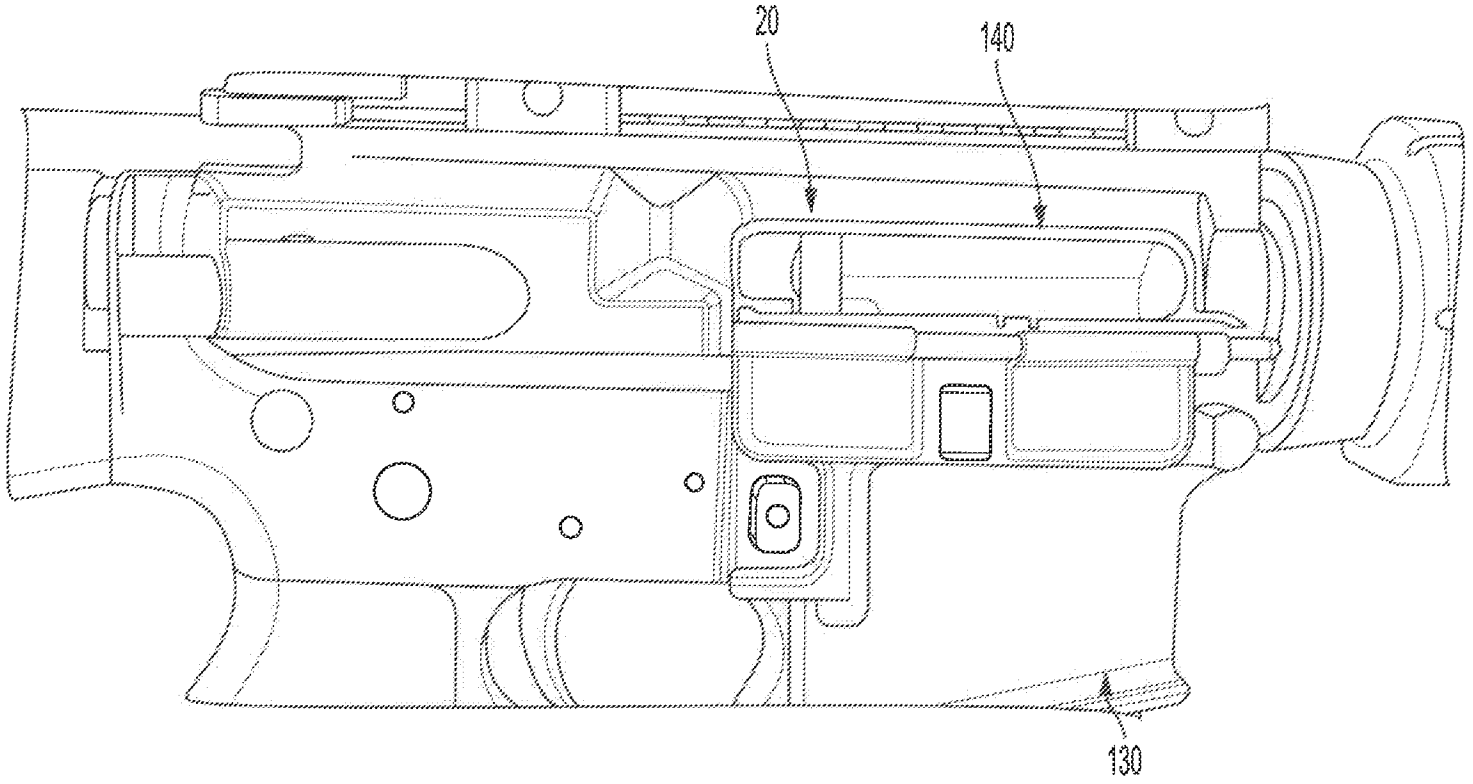
FIG. 9 is a generic firearm with an open bolt position.

Now looking at FIG. 9, a generic firearm 130 is displayed with what is known as an open-bolt position. In said position, the bolt 20 is locked in a rear position, and opens up the firearm chamber 140 itself. This is the position wherein ammunition is loaded within the firearm.

FIG. 10 shows a perspective view of a generic firearm 130. This shows the view of a firearm chamber 140 wherein the chamber throat 150 is shown. This is where the lugs 50 of a bolt 20 generally connect when the firearm 130 is ready for firing.

Figure 11:
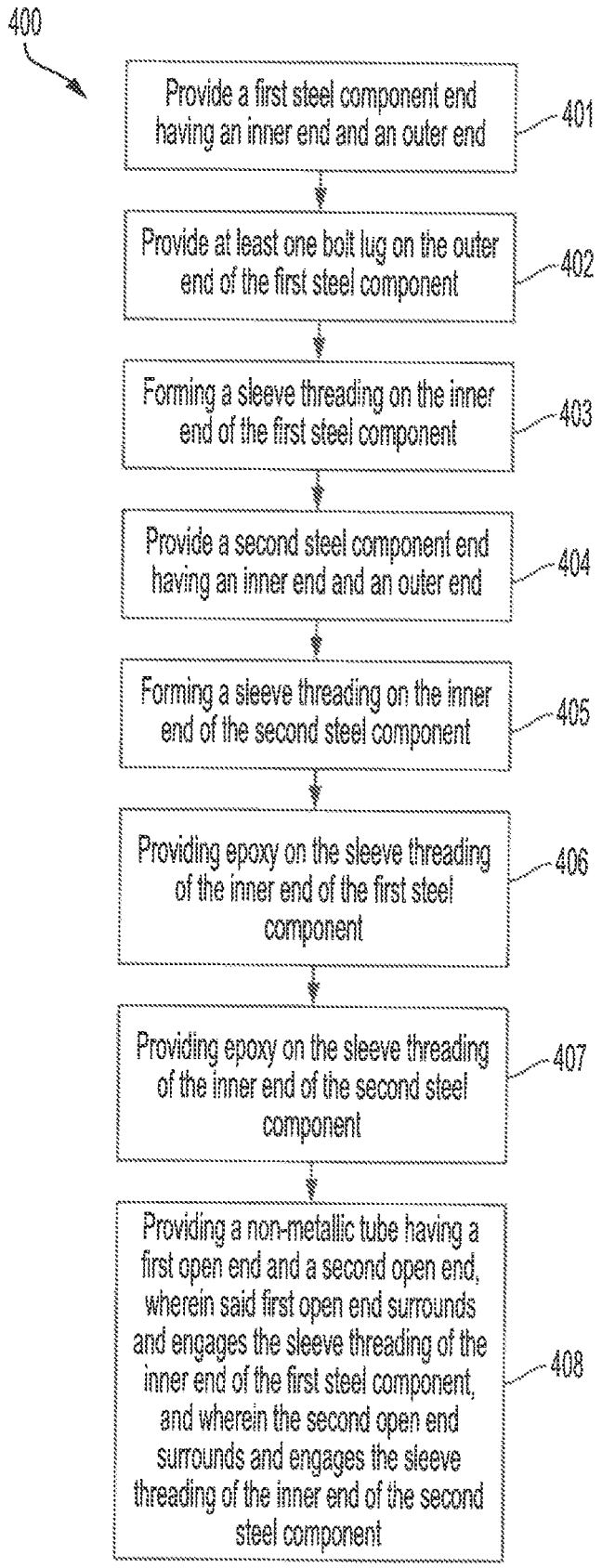
FIG. 11 is a method of manufacturing a firearm bolt having a non-metallic sleeve.

Lastly, FIG. 11 highlights a method of manufacturing a firearm bolt with a non-metallic sleeve 400. The steps therefore are providing a first steel component end which has an inner end and an outer end 401. Next, providing a bolt lug on the outer end of the first component 402. Next, forming a sleeve threading, otherwise known as screw threading, on the inner end of the first steel component 403. Next, providing a second steel component end with an inner end and an outer end 404. Next, providing sleeve threading on the inner end of the second steel component 405. Next, providing and applying epoxy onto the sleeve threading of the first steel component 406 and providing and applying epoxy onto the sleeve threading of the second steel component 407. Next, providing a non-metallic tube, which is generally hollow and has a first open end and a second open end, wherein the first open end receives the sleeve threading of the inner end of the first steel component and the second open end of the non-metallic tube receives the sleeve threading of the inner end of the second steel component 408. The non-metallic tube thus is affixed by way of the epoxy to the sleeve threading of both the first steel component and the sleeve threading of the second steel component.

Understandably, the present invention has been described above in terms of one or more preferred embodiments and methods. It is recognized that various alternatives and modifications may be made to these embodiments and methods that are within the scope of the present invention. Various alternatives are contemplated as being within the scope of the present invention. It is also to be understood and appreciated that, although the foregoing description and drawings describe and illustrate in detail one or more preferred embodiments of the present invention, to those with skill in the art to which the present invention relates, the present disclosure will suggest many modifications and constructions, as well as widely differing embodiments and applications without thereby departing from the spirit and scope of the invention and method disclosed thereof.

What is claimed is:

1. A firearm bolt with a non-metallic tube comprising:
- a first bolt piece having an outer end and an inner end;
- a second bolt piece having an outer end and an inner end;
- wherein said first bolt piece inner end additionally comprises sleeve threading;
- wherein said second bolt piece inner end additionally comprises sleeve threading;
- a non-metallic tube with an inner diameter and an outer diameter, said non-metallic tube having a first end and a second end;
- wherein said inner diameter of the non-metallic tube at the first end is sized so as to receive the first bolt piece inner end sleeve threading; and
- wherein said inner diameter of the non-metallic tube at the second end is sized so as to receive the second bolt piece inner end sleeve threading.

2. The firearm bolt with a non-metallic sleeve of claim 1, wherein said non-metallic tube comprises carbon fiber.

3. The firearm bolt with a non-metallic tube of claim 2, further comprising epoxy on the sleeve threading of the first bolt piece inner end, and further comprising epoxy on the sleeve threading of the second bolt piece inner end.

4. The firearm bolt with a non-metallic tube of claim 3, wherein the outer end of the first bolt piece additionally comprises a bolt lug.

5. The firearm bolt with a non-metallic tube of claim 4, wherein the inner end diameter of the first bolt piece is a lesser diameter than the outer end diameter of the first bolt piece, and wherein the inner end diameter of the second bolt piece is a lesser diameter than the outer end diameter of the second bolt piece.

6. The firearm bolt with a non-metallic tube of claim 5, wherein said first bolt piece and said second bolt piece are both constructed of steel.

7. The firearm bolt with a non-metallic tube of claim 6, wherein the sleeve threading of the first bolt piece inner end is cross-hatched.

8. The firearm bolt with a non-metallic tube of claim 7, wherein the sleeve threading of the second bolt piece inner end is cross-hatched.

9. The firearm bolt with a non-metallic tube of claim 8, wherein multiple layers of carbon fiber are wrapped around the non-metallic tube outer diameter.

* * * * *